US005259827A

United States Patent [19]

Staniszewski et al.

[11] Patent Number: 5,259,827

[45] Date of Patent: Nov. 9, 1993

[54] APPARATUS FOR FOLDING A PAPER SHEET

[76] Inventors: Tadeusz Staniszewski, 33 Karen Pl., Budd Lake, N.J. 07828; Arthur L. Arledge, 104 Lyons Rd., Basking Ridge, N.J. 07920; Richard Hollerith, 21 S. Bayard La., Mahwah, N.J. 07430

[21] Appl. No.: 820,919

[22] Filed: Jan. 15, 1992

[51] Int. Cl.[5] ..... B54H 45/12

[52] U.S. Cl. ..... 493/451; 493/23

[58] Field of Search ..... 493/23, 405, 416, 417, 493/451, 250, 252; 270/39, 45

[56] References Cited

U.S. PATENT DOCUMENTS

| | | | |
|---|---|---|---|
| 514,013 | 2/1894 | Litchfield . | |
| 747,085 | 12/1903 | Rieffel . | |
| 797,864 | 8/1905 | Naylor . | |
| 1,006,645 | 10/1911 | Froehlich | 493/252 |
| 3,502,322 | 3/1970 | Cran | 493/418 |
| 3,700,230 | 10/1972 | Cook | 270/61 |
| 3,717,366 | 2/1973 | Decker | 281/21 |
| 3,753,558 | 8/1973 | Sheroff et al. | 270/67 |
| 4,060,227 | 11/1977 | Landgraf | 493/23 |
| 4,421,500 | 12/1983 | Smith | 493/405 |
| 4,502,711 | 3/1985 | Muth | 281/5 |
| 4,571,237 | 2/1986 | Vogtlander | 493/416 |
| 4,636,192 | 1/1987 | Vogtlander et al. | 493/451 |
| 4,647,029 | 4/1987 | Ohmori | 270/45 |
| 4,865,579 | 9/1989 | Kirby | 493/405 |
| 7,020,085 | 6/1902 | Barnes . | |

*Primary Examiner*—Bruce M. Kisliuk
*Assistant Examiner*—Jack Lavinder
*Attorney, Agent, or Firm*—Thomas L. Adams

[57] ABSTRACT

Apparatus for folding a paper sheet includes a pair of spaced parallel flaps pivotally mounted on a frame. A die has an inner side and is mounted on the frame between the flaps to allow insertion of the paper sheet to a loaded position on the inside of the die and in front of the flaps. An actuator is coupled to the flaps for alternately closing them against the inner side of the die to doubly fold the paper sheet.

17 Claims, 8 Drawing Sheets

APPARATUS FOR FOLDING A PAPER SHEET

BACKGROUND OF THE INVENTION

The present invention relates to paper folders and in particular to a compact device for folding paper sheets singly or as a group.

Much clerical labor is spent folding letters before inserting them into envelopes. Often the volume of letters is large enough to make folding time consuming but not so large as to justify devoting office space to bulky and expensive folding machines.

Known mechanical devices have included a doubly hinged panel onto which a paper sheet is placed By manually folding the panel twice, the letter itself is folded. This type of device does not save much labor, since the operator must still manipulate the hinged panels of the folder. See also U.S. Pat. Nos. 514,013 and 747,085.

High volume folding machines can include rollers for directing the incoming paper along various paths For example, in U.S. Pat. No. 4,647,029 the apparatus flexes and then folds the paper by means of rollers. While this apparatus is very efficient it is relatively complicated and occupies much space. This complicated and bulky machine is ideal for high volume, but disadvantageous for personal use by a secretary who has a modest number of letters to stuff in an envelope.

See also U.S. Pat. Nos. 514,013; 702,085; 747,085; 797,864; 3,700,230; 3,717,366; 3,753,558; 4,421,500; 4,502,711; 4,636,192; 4,647,029; 4,571,237.

Accordingly there is a need for a simple device for folding letters, which is not overly complicated and does not occupy a large volume of space at the desk of a user.

SUMMARY OF THE INVENTION

In accordance with the illustrative embodiments demonstrating features and advantages of the present invention, there is provided an apparatus for folding a paper sheet. The apparatus includes a frame and a pair of spaced parallel flaps pivotally mounted on the frame. The apparatus also includes a die having an inner side. The die is mounted on the frame between the flaps to allow insertion of the paper sheet to a loaded position on the inside of the die and in front of the flaps. Also, included is an actuation means coupled to the flaps for alternately closing them against the inner side of the die to doubly fold the paper sheet.

In a preferred embodiment, a relatively small case has a slit opening for receiving a paper sheet that fits under a die. Folding flaps are hinged at either side of the die. An actuator causes the flaps to fold alternately to bring the ends of the paper sheet around the die to doubly fold the sheet in a conventional way. After folding, the flaps retract and an ejector pushes the paper back through the slit opening.

In a preferred embodiment, the actuator is a linear cam driven by a lead screw. The cam has opposing camming edges for operating cam followers that move the folding flaps in a specific phase relationship. Preferably, the cam moves axially on the lead screw to one extreme position before reversing and returning to the start position. In one constructed embodiment, a delayed flap moves to a partially closed position and waits while a leading flap fully closes and returns to the partially closed position. Thereafter, the delayed flap closes to complete the folding.

The preferred ejector is a spring loaded hook that catches the edge of the fully folded paper sheet. The hook rides on and is powered by the retracting cam. The spring holding the hook is tensioned by the retracting cam. When the second flap reopens, the energy stored in the ejector spring ejects the folded paper out of the case.

In the preferred embodiment, the case is relatively small. The edge of the paper, when folding, brushes against the inside of the case and flexes reversely. Because brushing interference is allowed, the case can be made much smaller than one with full clearance and no brushing and reverse flexing. This reverse flexing inherently causes delays, which are accommodated by the timing of the folding flaps. By proper design, the dimensions of the case can be made fairly compact.

The folding flaps are mounted on a flexible hinge shaft. The flexible nature of the shaft allows the folding flaps to work with single or multiple sheets. The hinge shaft allows the flaps to yield, depending upon the number of sheets being folded. When multiple sheets are used, the flexible hinge shaft allows additional clearance under the closed flap.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein.

DETAILED DESCRIPTION OF THE PREFERRED EMBODIMENTS

Figure 1:
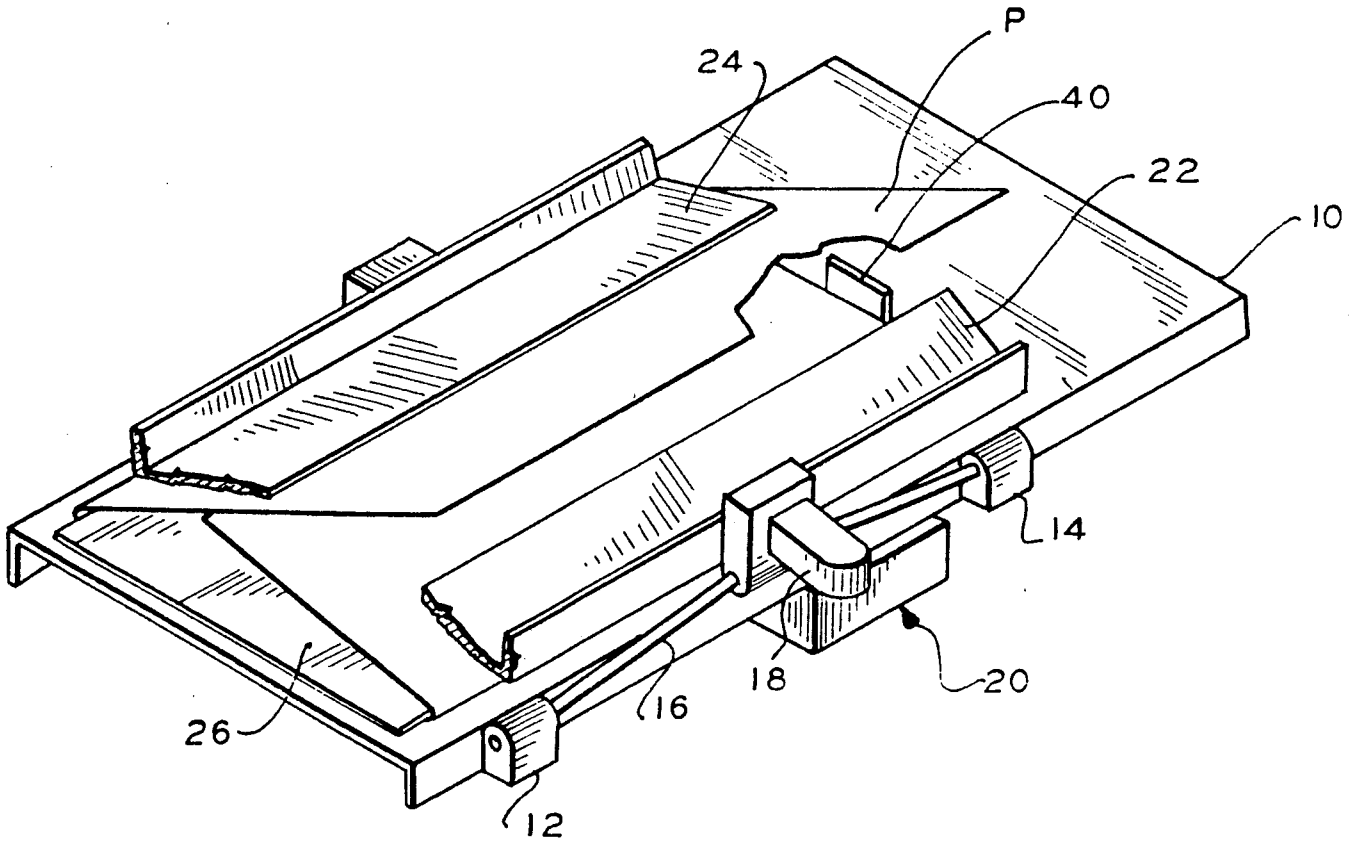
FIG. 1 is perspective view of a portion of the internal mechanism for folding a paper sheet in accordance with the principles of the present invention.
Figure 2:
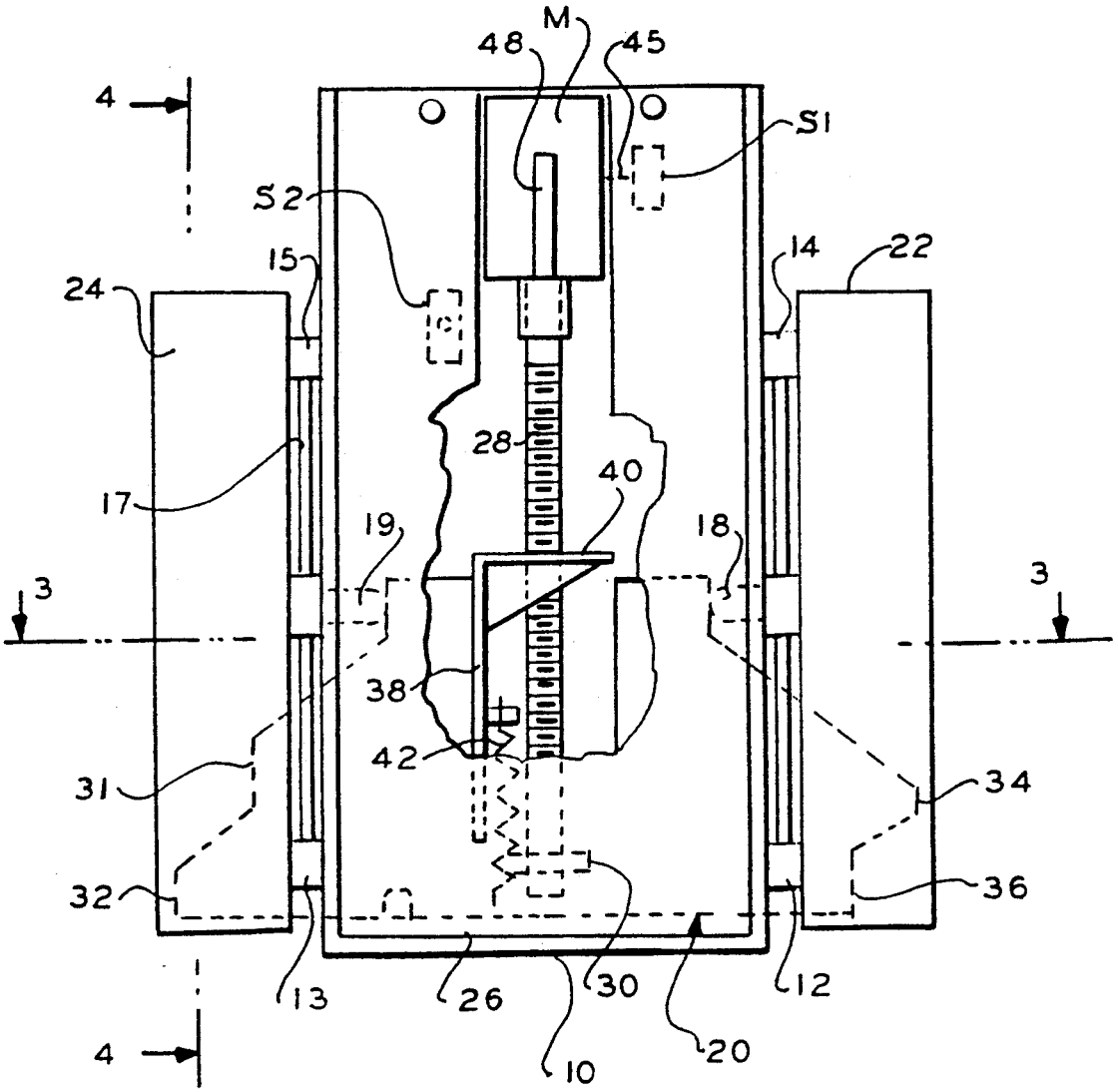
FIG. 2 is a plan view of the apparatus of FIG. 1 with its flaps fully opened.
Figure 3:
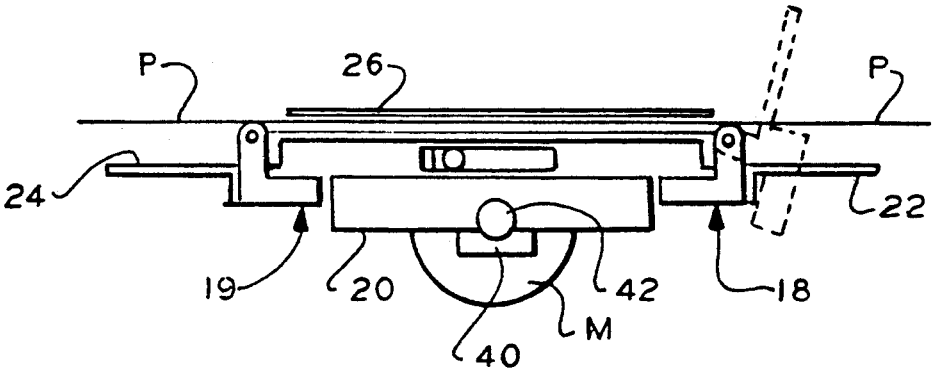
FIG. 3 is an end view along lines 3—3 of FIG. 2.

Referring to FIGS. 1, 2 and 3, the illustrated apparatus can fold paper sheet P. Frame 10 is a plate having dependent flanges supporting journal blocks 12 and 14. Rotatably mounted in blocks 12 and 14 is a hinge shaft 16 shown flexing upward (FIG. 1) in an exaggerated way. Similarly, blocks 13 and 15 (FIG. 2) support hinge shaft 17. Pivotally mounted on hinge shafts 16 and 17 are cam followers 18 and 19, respectively, whose appearance may be considered merely schematic, in these figures. Cam followers 18 and 19 each have a projection that is driven by an actuation means, shown herein as cam 20.

Flaps 22 and 24 are hinged to shafts 16 and 17 and attached to cam followers 18 and 19. In this embodiment, flaps 22 and 24 are in the form of sheet metal angle whose width (longer flange) are slightly less than one sixth of the length of paper sheet P. This means that the short edges of paper sheet P extend considerably beyond the extreme edges of flaps 22 and 24. Mounted above and parallel to frame 10 is a panel-like die 26 which acts as a folding guide cooperating with the folding flaps 22 and 24.

Mounted under frame 10 is a motor means M shown herein as a DC motor. The output shaft of motor M drives lead screw 28. Riding on lead screw 28 is a rectangular nut 30, which occupies a cavity in cam 20. Cam 20 is shown having a central plateau 31 and a terminal peak 32 on one camming edge and on the other camming edge a central peak 34 and terminal plateau 36. Cam 20 is shown in its start position in FIG. 2. It will be appreciated that the motor M can turn lead screw 28 to draw the cam 20 towards the motor until the cam 20 reaches its terminal position close to the motor M.

Slidably mounted in a slot in cam 20, is an ejection means, shown herein as ejector 38. Ejector 38 has an outer hook 40 in the form of a tab, sized to catch the edge of paper sheet P. In FIG. 2, ejector 38 is shown fully retracted to its home position As it extends away from cam 20, ejector 38 moves to a trailing position. Spring 42 is mounted between a peg on ejector 38 and a similar peg (not shown) on cam 20.

A start switch S1 is shown having an actuating arm 45 that extends through an opening in frame 10, alongside motor M. Switch S1 is positioned so that paper entering the apparatus can operate switch S1 and start motor M, in a manner to be described presently. A reversing switch S2 is shown mounted below frame 10 in a position to be operated by cam 20 when it reaches its terminal position. The underside of cam 20 has bosses (shown hereinafter) for setting and resetting switch S2. This switch operation reverses the motor direction and allows completion of the operation cycle in a manner to be described presently.

Figure 4:
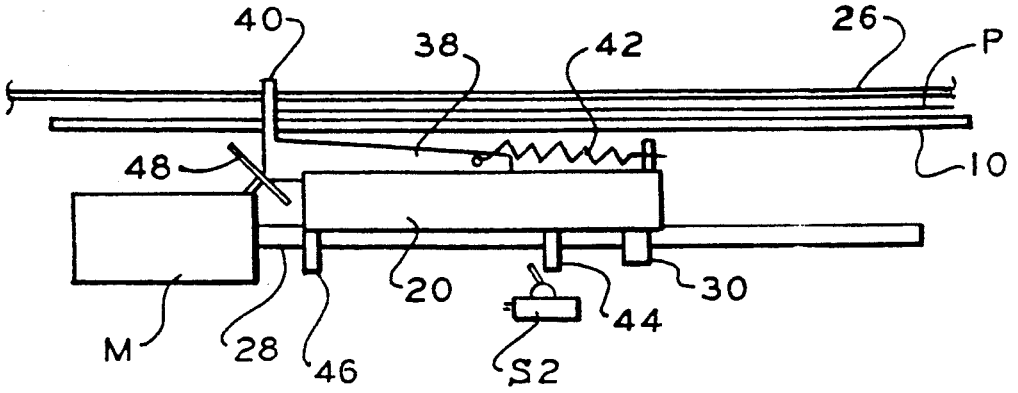
FIG. 4 is a side view along lines 4—4 of FIG. 2.

In FIG. 4, ejector 38 is shown lifted by ramp 48 to a position where it can catch the edge of paper sheet P. Ramp 48 is mounted on motor M. Also, bosses 44 and 46 are shown depending from the underside of cam 20 for setting and resetting switch S2.

Figure 6:
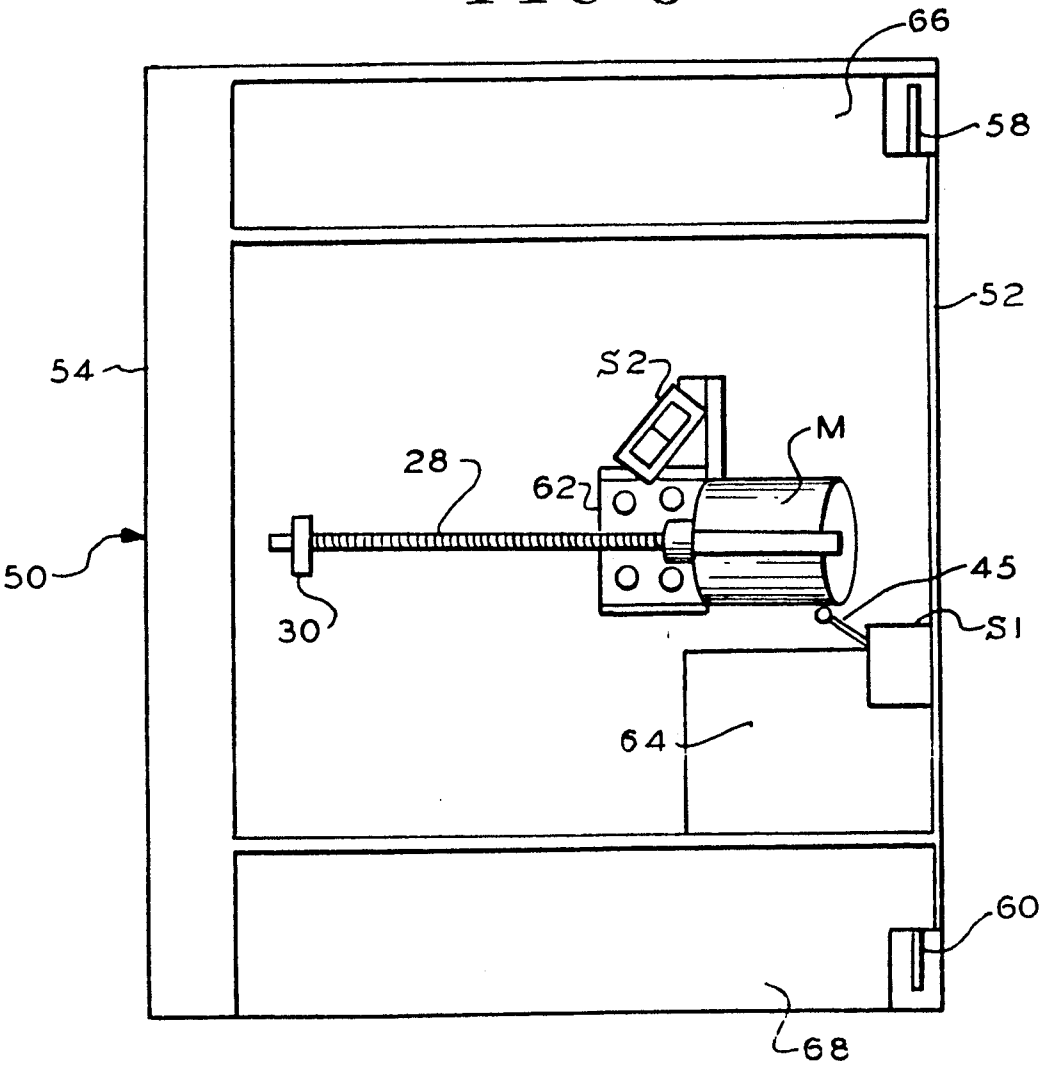
FIG. 6 is a plan view of the case of FIG. 5 with its cover and the apparatus of FIG. 1 removed.
Figure 5:
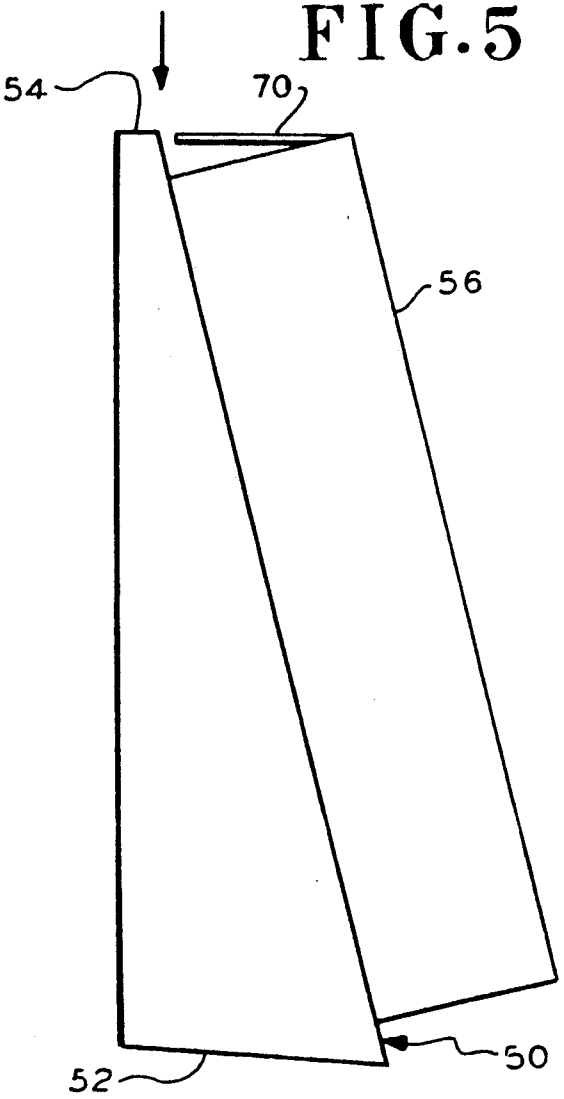
FIG. 5 is a side view of the case for the apparatus of FIG. 1.

Referring to FIGS. 5 and 6, a case is shown having a base 50 in the form of a rectangular tray whose bottom face 52 is wider than its top face 54. It will be appreciated that in some embodiments the top and bottom faces can have the same size. A hollow rectangular cover 56 is mounted on hinge pins 58 and 60. Cover 56 can be urged by springs (not shown) to stay in the closed position as illustrated in FIG. 5. The top of cover 56 has a flap gate 70 that is used to allow folded paper to leave case 50 without retreating from its own weight.

A motor mount 62 in FIG. 6 is attached to the illustrated wall of case 50. Motor mount 62 has one flange (not illustrated) attached to motor M and another flange bolted to the case 50 through rubber grommets (not illustrated). Also mounted on mount 62 is previously illustrated reversing switch S2, shown herein as a rocker switch, although other types of switches can be employed instead On the illustrated wall of case 50, is previously mentioned start switch S1. Switch S1 has an actuator arm 45 that extends approximately perpendicular to the axis of motor M to sense the loading of paper into case 50. A motor controller 64 is mounted as illustrated in FIG. 6. Wedged shaped side compartments 66 and 68 in case 50 may contain batteries for those units that are portable.

Figure 7:
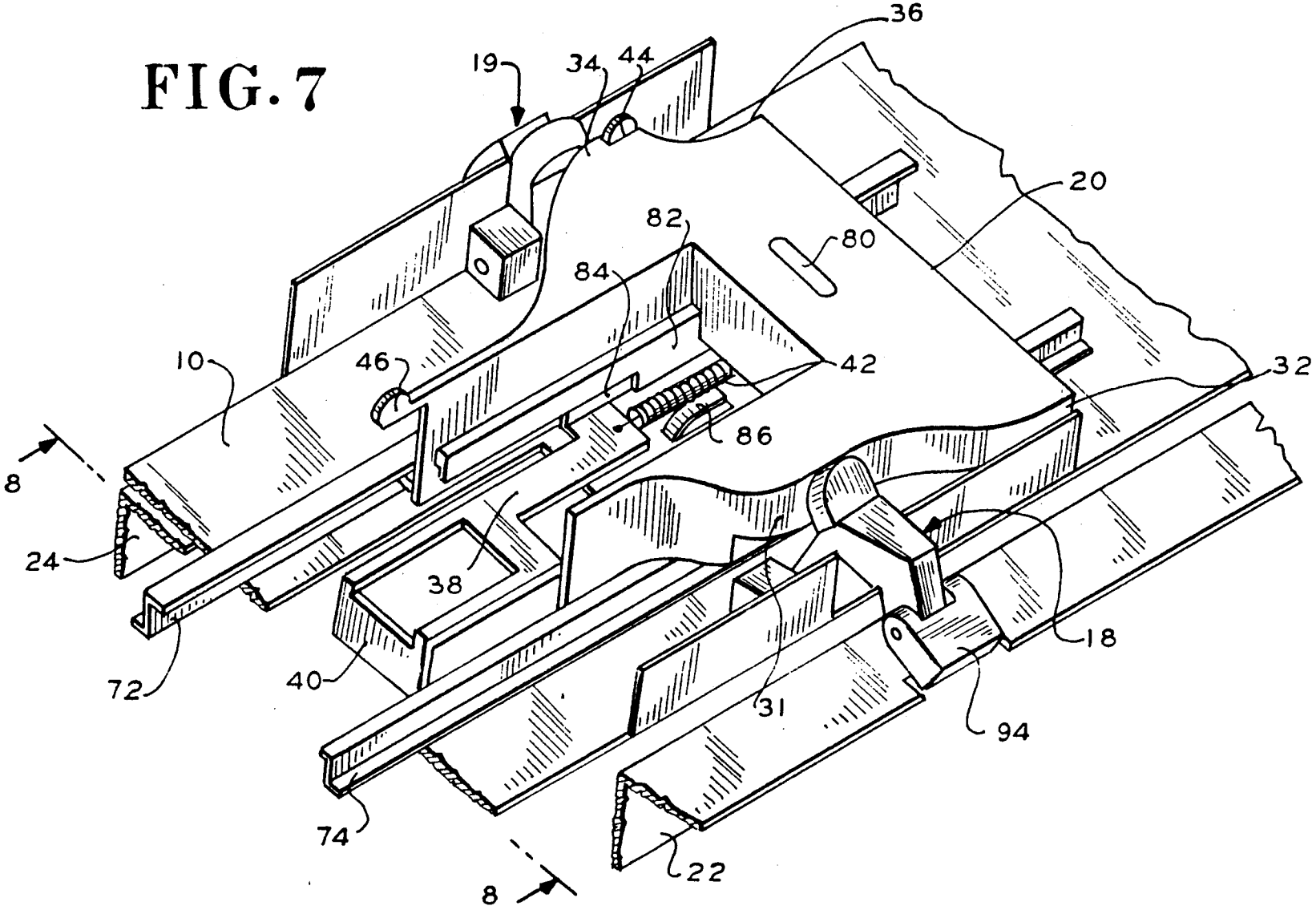
FIG. 7 is a perspective view of the cam that is on the underside of the apparatus of FIG. 1.
Figure 8:
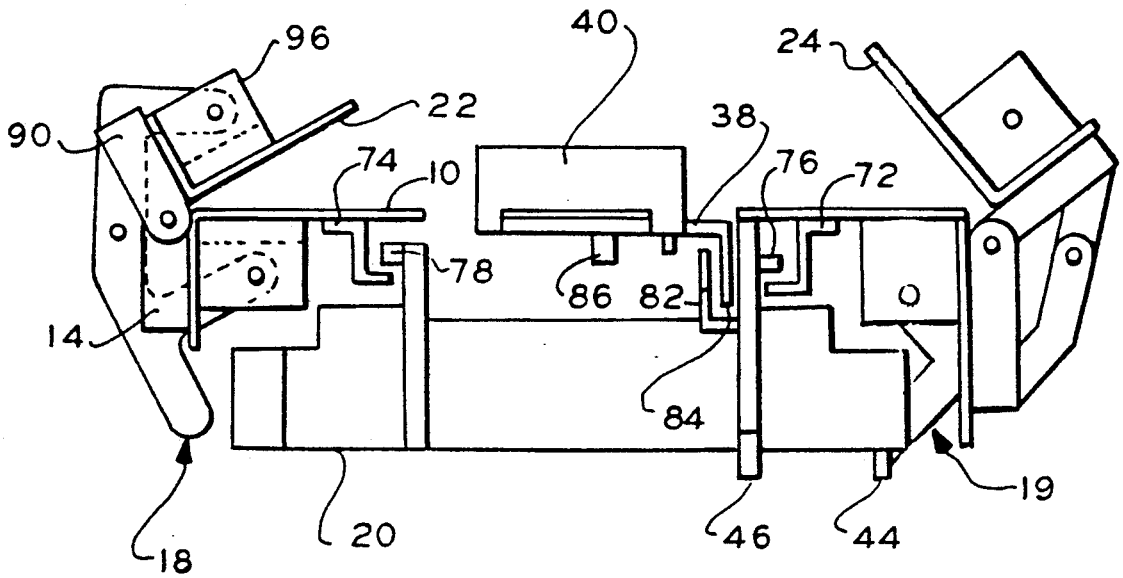
FIG. 8 is an end view of the apparatus of FIG. 7 along lines 8—8, but inverted.
Figure 9:
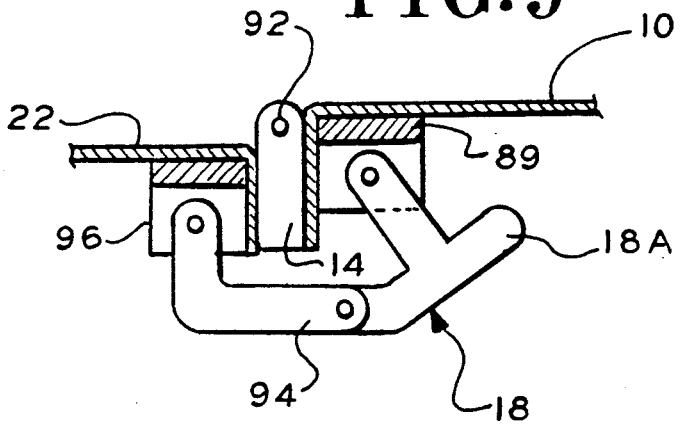
FIG. 9 is a detailed view of the hinge on the left of FIG. 8 in a partially closed position.

Referring to FIGS. 7, 8 and 9, frame 10 is shown with a cutout producing a U-shaped plan. Mounted on the underside of frame 10, are a pair of parallel Z-shaped rails 72 and 74. Cam 20 has a cutout giving cam 20 a U-shaped plan. At the inside face of cam 20 are outwardly directed shelves 76 and 78, which interlock with rail 72 and 74, respectively. The outside face of cam 20 has cavity 80 for receiving the previously illustrated nut (nut 30 of FIG. 6). Also on the outside face are previously mentioned bosses 44 and 46 for actuating the reversing switch (switch S2 of FIG. 6). Within the U-shaped cutout of cam 20 is an inwardly directed gutter 82. Ejector 38 is slidably mounted in gutter 82. Ejector 38 has a relatively long prong 84 that is held between frame 10 and gutter 82. Prong 84 attaches at right angles to the main ejector body prong 38. The outer end of ejector prong 38 is forked to support the inwardly projecting hook 40.

In FIG. 7, cam 20 is in an intermediate position between its start and terminal position. As shown, ejector prong 38 is adjacent to a ramp 86, a narrow punchout in frame 10. As cam 20 moves to the start position (to the right in FIG. 7) ejector prong 38 rides ramp 86 to retract hook 40 to the far side of frame 10. This retracts hook 40 so that fresh paper can be loaded without interference.

The details of the cam follower 18 are shown in FIG. 9. It will be appreciated that the details of follower 19 are similar. Referring to FIGS. 7 and 9, cam follower 18 is shown as an arch pivotally connected on one end to bifurcated block 89. The other end of the arch of cam follower 18 is pivotally connected to the forked end of link 94. The link 94 is an L-shaped body whose unforked, outer end is pivotally connected to bifurcated block 96, which is mounted in the inside corner of flap 22. Block 89 is mounted in the inside corner of frame 10. Journal block 14 is shown mounted on the flange of frame 10. Journal block 14 is affixed to frame 10 and pivotally supports through pin 92, the journal block 90. Block 90 is attached to the flange of flap 22. It will be appreciated that by applying force to the tip of projection 18A of cam follower 18, it will rotate clockwise (in the sense shown in FIG. 9), causing flap 22 to similarly rotate clockwise.

Figure 10:
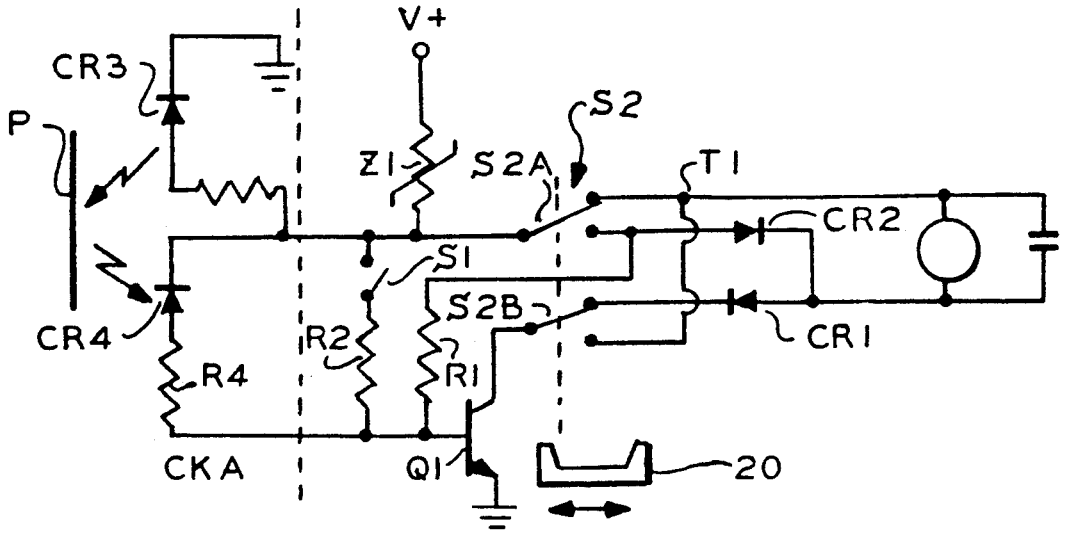
FIG. 10 is a schematic diagram of the motor controller for driving the motor of FIG. 6.

Referring to FIG. 10, previously mentioned reversing switch S2 is shown as a double pole, double throw switch having switching blades S2A and S2B. The blades S2A and S2B are illustrated in the "forward" position. Blade S2B, in the illustrated position, connects through one switch contact to the cathode rectifier CR1. Blade S2A, in the illustrated position, connects through another switch contact to terminal T1 of capacitively shunted motor M, whose other terminal connects to the cathode of rectifier CR2 and the anode of rectifier CR1. The switching contacts that will connect to blades S2A and S2B when they switch, connect to the anode of rectifier of CR2 and terminal T1, respectively.

The anode of rectifier CR2 also connects through resistor R1 whose other terminal connects to the base of NPN transistor Q1 whose emitter is grounded. The collector of transistor Q1 connects to blade S2B. Solid state device Z1 acts like a fuse, in that excess current will trip the device. Device Z1 will reset when normal current conditions resume. A device such as Z1 can be purchased under the trademark PolySwitch, although in some embodiments a conventional fuse will be used instead. Device Z1 connects between positive potential V+ and the blade S2A. Blade S2A connects to one terminal of switch S1, whose other terminal connects through resistor R2 to the base of transistor Q1. Switch S1 is the previously illustrated start switch. As explained before, start switch S1 will close when paper is loaded An alternative circuit CKA is shown connected in parallel to the serial combination of switch S1 and resistor R2. Circuit CKA can replace switch S1 and resistor R2. Circuit CKA has a resistor R3 connected between blade S2A and the anode of the light emitting diode CR3, whose cathode is grounded. Blade S2A is also connected to the cathode of photosensitive diode CR4, whose anode is connected through resistor R4 to the base of transistor Q1. As illustrated, light from diode CR3 can be reflected back by paper P to light sensitive diodes CR4. This optical connection can cause a low impedance connection from blade S2A to the base of Q1, in a manner similar to the function provided by switch S1.

Operation is commenced when switch S1 closes (switch S2 remaining in the illustrated position), applying current to the base of transistor Q1, turning it on. Consequently current from source V+ can flow through blade S2A and motor M, returning through blocking rectifier CR1 and blade S2B to the collector of "on" transistor Q1. Eventually, when reversing switch S2 is actuated, current then flows through blade S2A and rectifier CR2 through motor M, but in the reverse direction. Consequently, motor M reverses direction. The reverse current through motor M returns through blade S2B to the collector of "on" transistor Q1.

Transistor Q1 now is turned on by a second source: positive voltage applied by blade S2A through resistor R1 into the base of transistor Q1. Thus, resistor Q1 is self latched by blade S2A. Consequently, switch S1 can then open without further effect. Normally, switch S1 does open when the motor first reverse direction, but occurs soon after. As the paper ejection continues, eventually switch S2 returns to its original condition as shown in FIG. 10. This breaks the current flow through resistor R1, turning transistor Q1 off. Therefore no further current can flow through motor M. This returns the circuit to the initial conditions, with motor M in its "home" position.

To facilitate an understanding of the principles associated with the foregoing apparatus, its operation will now be briefly described, particular reference being made to FIG. 11. When paper P is first loaded, it takes the position shown in FIG. 11A with paper P located between case base 50 and cover 56. Because the paper is not folded, gate 70 does not interfere with paper insertion. When paper P is loaded into case base 50, it eventually pushes actuator 45 (FIG. 6) of switch S1. As described in connection with FIG. 10, switch S1 starts motor M to rotate lead screw 28 and draw inwardly the nut 30. The nut fits into the cavity 80 (FIG. 7) and draws cam 20 to the left as shown in FIG. 7. Cam 20 rides on rails 72, 74 on frame 10. As cam 20 moves, flaps 22 and 24 take the intermediate position illustrated in FIG. 11B. In this condition, paper P is folded half way. Significantly, the clearance under cover 56 is less than a third of the paper length. Consequently, paper P flexes reversely as illustrated in FIG. 11B.

Figures 11A, 11B, 11C, 11D:
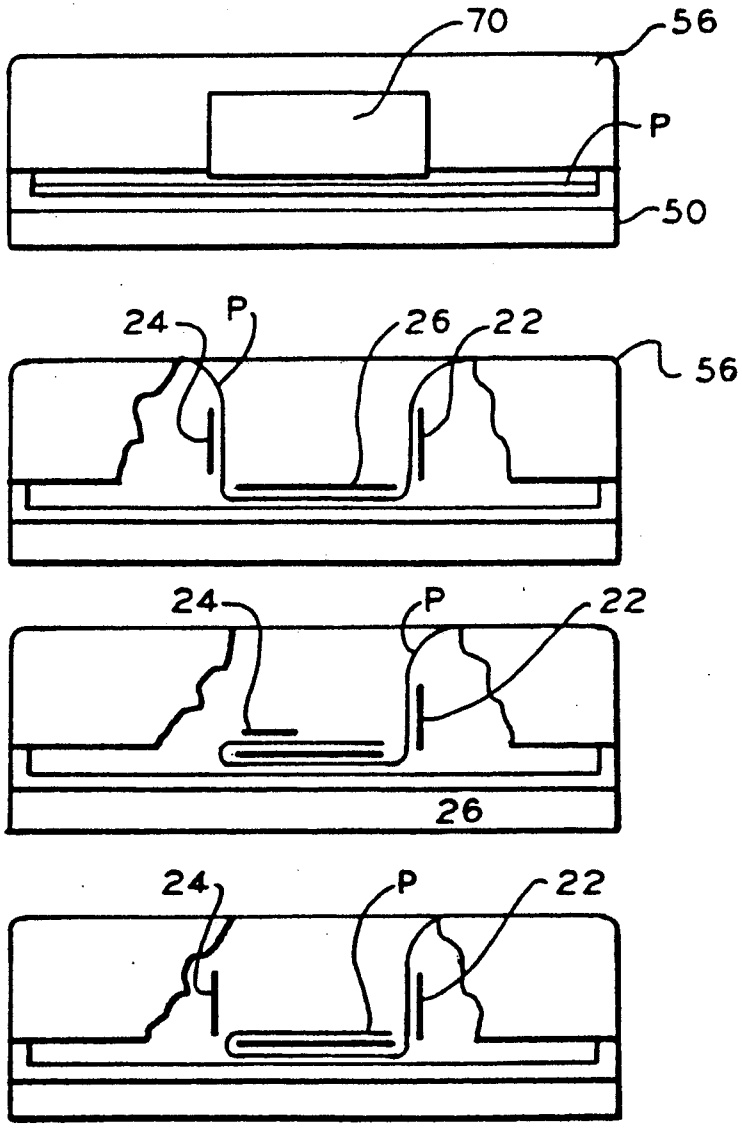
FIG. 11 shows in diagrams A-H the various flap positions of the apparatus of FIG. 1.
Figure 11E:
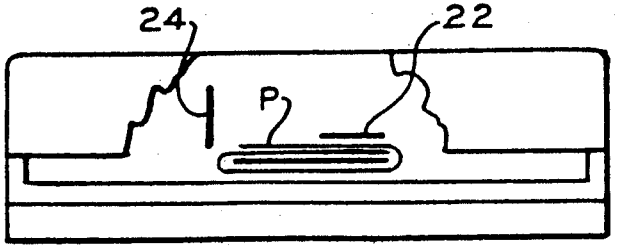

Flap 24 continues to move and closes on die 26 as illustrated in FIG. 11C. This condition corresponds to that illustrated in FIG. 7 wherein the cam follower 19 is on a central peak 34 and cam follower 18 is on a central plateau 30 of cam 20. As cam 20 continues to move, flaps 22 and 24 next return to the positions shown in FIG. 11D. One side of paper P stays folded as illustrated. As the cam 20 continues to move, cam follower 19 (FIG. 7) moves to the terminal plateau 36, while cam follower 18 moves to the terminal peak 32. As a result, flap 22 closes and flap 24 remains in the partially closed position as illustrated in FIG. 11E. This doubly folds paper P. As cam 20 moves further, eventually boss 44 (FIG. 7) strikes the outside face of rocker switch S2 (FIG. 6). This actuates the reversing switch to reverse the direction of motor M. Consequently, the actions of flaps 22 and 24 of FIG. 11 now reverse their motions.

Figure 11F:
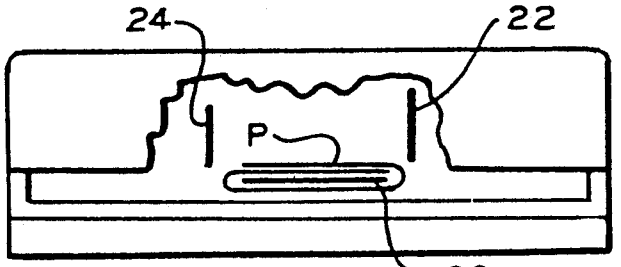

Accordingly, in FIG. 11F, flaps 22 and 24 reach the intermediate positions corresponding to that shown before in FIG. 11D. At this time, cam 20 has moved somewhat towards the start position. By this time, the hook 40 has ridden up on the ramp 48 (FIG. 4). Therefore, hook 40 engages one edge of folded paper P and begins to bring it out of the apparatus. In the condition illustrated in FIG. 11F, the folded paper P moves outwardly while folded around die 26.

Figure 11G:
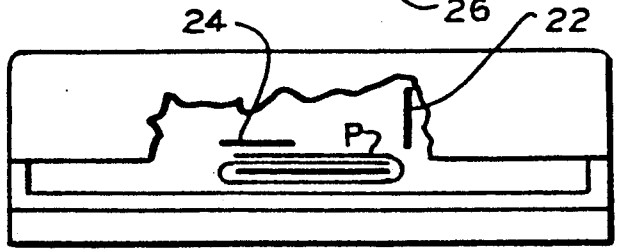

As cam 20 continues to move, it eventually reaches the position illustrated in FIG. 7 where flap 24 is again closed while flap 22 remains in the partially closed position. This is illustrated in FIG. 11G. This second closing of flap 24 is a snubbing operation which stops paper P from moving further. Although cam 20 moves, hook 40 stays in place (FIG. 7). At this time, however, ejector prong 84 slides in the gutter 82 to generate force as regulated by extension spring 42.

Figure 11H:
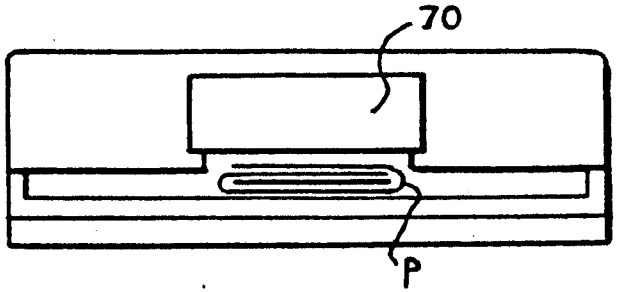

Eventually, both flaps 22 and 24 will release paper P as shown in FIG. 11H. At this time, the energy stored in spring 42 (FIG. 7) will cause hook 40 to throw the folded paper out of the case. At this time, the gate 70 will allow paper P to move outwardly, but not inwardly. Eventually, boss 46 (FIG. 7) will operate reversing switch S2 to stop motor M in the manner previously described.

It is to be appreciated that various modifications may be implemented with respect to the above described preferred embodiments. The cam can be made out of plastic although in some embodiments metal or other materials may be used instead. While a sliding cam is illustrated, in some embodiments a rotating dual cam can be employed to actuate the folding flaps instead. In such an embodiment, the ejector hook can be operated by a crank connected to the cam shaft. While a vertically oriented case is shown, the case can be mounted horizontally. Also, instead of feeding and ejecting in the same opening, the apparatus can be constructed so that paper feed in one end an leaves from the opposite end. While the case is shown having a slanted side, in some embodiments the case may be rectangular. Also the dimensions of the various components can be altered depending upon the size, weight and number of paper sheets being handled. Additionally, the size, speed and torque of the motor can be altered depending upon the paper handling requirements. Furthermore, the power for the motor can be derived from either a battery or in some cases from house current.

Obviously, many modifications and variations of the present invention are possible in light of the above teachings. It is therefore to be understood that within the scope of the appended claims, the invention may be practiced otherwise than as specifically described.

We claim:

1. Apparatus for folding a paper sheet comprising:

a frame;

a case containing said frame and having an opening for receiving the paper sheet, said opening of said case having a predetermined length sized to receive the paper sheet dimensioned with a corresponding length;

a pair of spaced parallel flaps each having a front face and each being pivotally mounted on said frame to reciprocate between a load position and a closed position;

a die having a front side, said front side of said die and said front face of said flaps facing in the same direction when the flaps are in said load position, said die being mounted on said frame between said flaps to allow insertion of the paper sheet to a loaded position behind said die and in front of said flaps when said flaps are in said load position; and actuation means coupled to said flaps are alternately closing them against the front side of said die to doubly fold the paper sheet and wrap the paper sheet around said die, the clearance in the case in front of the front side of said die being sized with respect to said die to cause the paper sheet with said corresponding length to touch and be reversely flexed by the case during folding, said actuation means including ejection means for ejecting the paper sheet after folding.

2. Apparatus according to claim 1 wherein the actuation means simultaneously pivots both of said flaps toward a partially closed position before delaying one of said flap while the other one continues to a fully closed position against said die.

3. Apparatus according to claim 1 wherein the actuation means comprises:

a cam mounted on said frame to reciprocate and drive said flaps.

4. Apparatus according to claim 3 wherein said ejection means is operable to eject the paper sheet after folding, the ejection means being mounted on said cam to translate therewith.

5. Apparatus according to claim 4 wherein said cam has an opposite pair of camming edges and is mounted to slide in a directional parallel to the length of said flaps.

6. Apparatus according to claim 5 comprising: a case containing said frame and having an opening of a predetermined length sized to receive the paper sheet dimensioned with a corresponding length, the clearance in the case in front of the front side of said die being the paper sheet to touch and be reversely flexed by the case during folding.

7. Apparatus according to claim 6 wherein said ejection means comprises:

an ejector mounted on said cam to slide in a direction parallel to the length of said flaps.

8. Apparatus according to claim 7 wherein said camming edges of said cam each have a beginning portion, a central portion and a terminal portion, the cam having a central plateau on said central portion and a terminal peak on said terminal portion of one of said camming edges, the other one of said camming edges having a central peak on said central portion and a terminal plateau on said terminal portion.

9. Apparatus according to claim 8 wherein said ejector is mounted on said cam to slide between a home position and a trailing position in a direction parallel to the length of said flaps.

10. Apparatus according to claim 9 wherein said cam is operable to reciprocate between a start and a terminal position, said ejector being operable in its home position to catch an edge of the paper sheet when said cam is in its terminal position, said ejector being operable to move towards its trailing position and begin ejecting said paper sheet in response to said cam moving toward its start position.

11. Apparatus according to claim 10 wherein one of said flaps is operable to close against said die a second time to temporarily suspend ejection of the paper sheet and move said ejector toward said trailing position.

12. Apparatus according to claim 11 wherein said ejector is operable to fully eject the paper sheet by moving to said home position as said cam moves to its start position, said ejector transversely withdrawing to a retired position in response to said cam reaching said start position.

13. Apparatus according to claim 12 wherein said actuation means comprises:

a lead screw rotatably mounted on said frame and coupled to said cam to slide it axially in response to rotation of said lead screw; and motor means for rotating said lead screw.

14. Apparatus according to claim 13 wherein said actuation means comprises:

a start switch mounted in said case to switch in response to loading of the paper sheet into said case;

a reversing switch mounted in said case to switch in response to said cam reaching its terminal position; and a motor controller connected to said start switch and said reversing switch for starting said motor in response to said start switch and reversing said motor in response to said reversing switch.

15. Apparatus according to claim 14 wherein said actuation means comprises:

a pair of cam followers coupled to said flaps, said followers each comprising:

a follower lever pivotally mounted on said frame to bear against a corresponding one of said cam edges; and a link pivotally connected between said follower lever and a corresponding one of said flaps.

16. Apparatus according to claim 15 wherein said case includes a check gate alongside said opening for allowing unidirectional egress of the paper sheet after folding.

17. Apparatus for folding a paper sheet comprising:

a frame;

a pair of spaced parallel flaps each having a front face and each being pivotally mounted on said frame to reciprocate between a load position and a closed position;

a die having a front side, said front side of said die and said front face of said flaps facing in the same direction when the flaps are in said load position, said die being mounted on said frame between said flaps to allow insertion of the paper sheet to a loaded position behind said die and in front of said flaps when said flaps are in said load position; and actuation means coupled to said flaps are alternately closing them against the front side of said die to doubly fold the paper sheet and wrap the paper sheet around said die, said flaps having a spaced pair of flexible hinge shafts pivotally supporting said flaps to allow between them and said die a flexible clearance, so that the paper sheet can be folded simultaneously with an additional number of like sheets.

* * * * *